US008075361B2

(12) United States Patent
Muraki

(10) Patent No.: US 8,075,361 B2
(45) Date of Patent: Dec. 13, 2011

(54) ELECTRON SOURCE MANUFACTURING METHOD

(75) Inventor: Masato Muraki, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 12/544,824

(22) Filed: Aug. 20, 2009

(65) Prior Publication Data

US 2010/0062674 A1 Mar. 11, 2010

(30) Foreign Application Priority Data

Sep. 9, 2008 (JP) ..... 2008-231027

(51) Int. Cl.
*H01J 9/12* (2006.01)

(52) U.S. Cl. ..... 445/51; 445/46; 445/58

(58) Field of Classification Search ..... 445/46, 445/51, 58

See application file for complete search history.

(56) References Cited

U.S. PATENT DOCUMENTS

| | | | | |
|---|---|---|---|---|
| 5,834,783 | A | 11/1998 | Muraki et al. | |
| 5,973,332 | A | 10/1999 | Muraki et al. | |
| 6,166,387 | A | 12/2000 | Muraki et al. | |
| 6,274,877 | B1 | 8/2001 | Muraki | |
| 6,323,499 | B1 | 11/2001 | Muraki et al. | |
| 6,483,120 | B1 | 11/2002 | Yui et al. | |
| 6,515,409 | B2 | 2/2003 | Muraki et al. | |
| 6,784,442 | B2 | 8/2004 | Muraki et al. | |
| 6,903,352 | B2 | 6/2005 | Muraki et al. | |
| 7,005,659 | B2 | 2/2006 | Muraki et al. | |
| 7,049,610 | B2 | 5/2006 | Muraki et al. | |
| 2005/0181697 | A1 * | 8/2005 | Ashida et al. | 445/24 |
| 2005/0215162 | A1 * | 9/2005 | Adachi | 445/24 |

FOREIGN PATENT DOCUMENTS

JP 2001-167693 A 6/2001

* cited by examiner

*Primary Examiner* — Anne Hines

(74) *Attorney, Agent, or Firm* — Fitzpatrick, Cellar, Harper & Scinto

(57) ABSTRACT

A constitution that conductive members respectively having micropatterns are arranged in high density is manufactured in high accuracy. A conductive film is formed on a substrate, a negative photosensitive resin is applied, the applied resin is exposed by using a first mask having plural fine-width apertures extending in Y direction, and the resin is then exposed and developed by using a second mask having plural apertures extending in X direction perpendicular to Y direction, thereby forming a first resist. After the conductive film is etched by using the first resist as a mask, a negative photosensitive resin is again applied, and exposure and development are performed as shifting the second mask in Y direction, thereby forming a second resist. The conductive film is etched by using the second resist as a mask to eliminate unnecessary areas, thereby forming the conductive film having minute-lines extending in Y direction.

2 Claims, 7 Drawing Sheets

ELECTRON SOURCE MANUFACTURING METHOD

BACKGROUND OF THE INVENTION

1. Field of the Invention

The present invention relates to a manufacturing method of a conductive member using photolithography and etching, and a manufacturing method of an electron source using the manufacturing method of the conductive member.

2. Description of the Related Art

For example, Japanese Patent Application Laid-Open No. 2001-167693 discloses a laminated electron-emitting device as an electron-emitting device which emits electrons and is to be used for a flat panel display.

And, in an image displaying apparatus which uses the electron-emitting device like this, a method of high-reproducibly and high-accurately manufacturing an electron source that plural electron-emitting devices which are obtained by forming more electron-emitting portions in the electron-emitting devices corresponding to one pixel are arranged in higher density is desired.

SUMMARY OF THE INVENTION

The present invention aims to provide a method of high-accurately manufacturing, in a constitution in which conductive members each having a micropattern are arranged in high density, the relevant conductive members, and further to provide a method of manufacturing an electron source by using the relevant method of manufacturing the conductive members.

According to a first aspect of the present invention, there is provided a manufacturing method of manufacturing at least plural conductive members in a first direction, each of the plural conductive members having plural first lines parallelly extending in the first direction and a second line extending in a second direction perpendicular to the first direction and connecting the plural first lines, and a width of the first line taken along the second direction being larger than a width of the second line taken along the first direction, the manufacturing method being characterized by comprising: a film forming step of forming a conductive film on a substrate; a step of applying a negative photosensitive resin on the conductive film; a first exposing step of exposing the negative photosensitive resin by using a first mask which has plural aperture portions, respectively extending in the first direction, at pitches same as those of the first lines; a second exposing step of exposing the negative photosensitive resin by using a second mask which has aperture portions, each extending in the second direction in a width same as a maximum length of the conductive member taken along the first direction, at pitches same as those of the conductive members in the first direction; a step of forming a first resist by developing the negative photosensitive resin double-exposed; a step of forming a first conductive film pattern by etching the conductive film with use of the first resist as a mask; a step of applying a negative photosensitive resin on the substrate after the etching; a step of forming a second resist by exposing and developing the negative photosensitive resin in a state that the second mask is being shifted toward the first direction; and a step of forming a second conductive film pattern by etching the first conductive film pattern with use of the second resist as a mask.

According to a second aspect of the present invention, there is provided a manufacturing method of manufacturing an electron source in which plural electron-emitting devices, each of which has conductive members each having an electron-emitting portion between a pair of electrodes, are arranged on a substrate, the manufacturing method being characterized in that the conductive members are formed in the manufacturing method as described in the first aspect of the present invention. Further, the manufacturing method includes as a preferable aspect that the one electron-emitting device has the plural conductive members.

In the present invention, since it is possible to easily register (or align) the mask and the substrate in each exposing step, it is possible to high-accurately form the minute-line conductive member. As a result, it is possible to high-reproducibly manufacture the electron source in which the electron-emitting devices each having the plural fine-width conductive films are arranged in high density, whereby it is possible to provide high-quality and high-reliability image displaying.

Other features, objects and advantages of the present invention will be apparent from the following description when taken in conjunction with the accompanying drawings, in which like reference characters designate the same or similar parts throughout the figures thereof.

DESCRIPTION OF THE EMBODIMENT

Hereinafter, the embodiment of the present invention will be described in detail with reference to the attached drawings.

A conductive member which is manufactured by a conductive member manufacturing method according to the present invention has plural first lines which parallelly extend in a first direction and a second line which extends in a second direction perpendicular to the first direction and connects the plural first lines. More specifically, there is a comblike conductive member 4*c* as illustrated in FIG. 3C. The present invention is directed to the method of manufacturing at least plural suchlike conductive members in the first direction. Incidentally, in the following description, it is assumed that the first direction is called a Y direction and the second direction is called an X direction as a matter of convenience.

In the conductive member manufactured according to the present invention, as illustrated in FIG. 3C, a width x4 of each of the first lines is smaller than a width y4 of the second line. That is, the first lines are micropatterns. In a case where the relevant micropatterns are manufactured by using photolithography and etching, it is necessary to increase an NA (numerical aperture) of an optical system of an exposing apparatus to make the width x4 fine. However, according as the NA is increased, a depth of focus becomes narrow. In a case where the present invention is applied to a display having a large screen, flatness of the substrate to be used for a large-sized panel display is several tens of micrometers. For this reason, if the NA is increased, it becomes difficult to provide the micropatterns on the overall substrate.

Consequently, in the present invention, a negative photosensitive resin is applied onto the substrate, and double exposure in which deep-depth two-beam interference exposure using a phase grating mask and exposure using an ordinary mask for an MPA (Mirror Projection maskAligner) are combined is performed, whereby a high-accuracy resist is manufactured. Moreover, in the present invention, after first etching using the above manufactured resist is performed, a second resist is formed by again using the mask for the MPA, whereby an unnecessary area is trimmed.

Figure 1A:
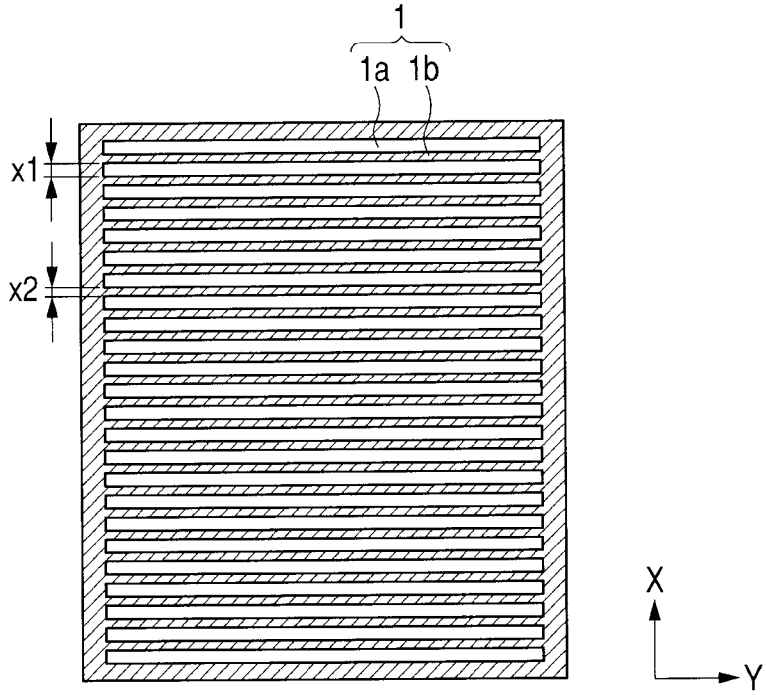
FIGS. 1A and 1B are plane schematic views respectively illustrating masks to be used in the present invention.
Figure 1B:
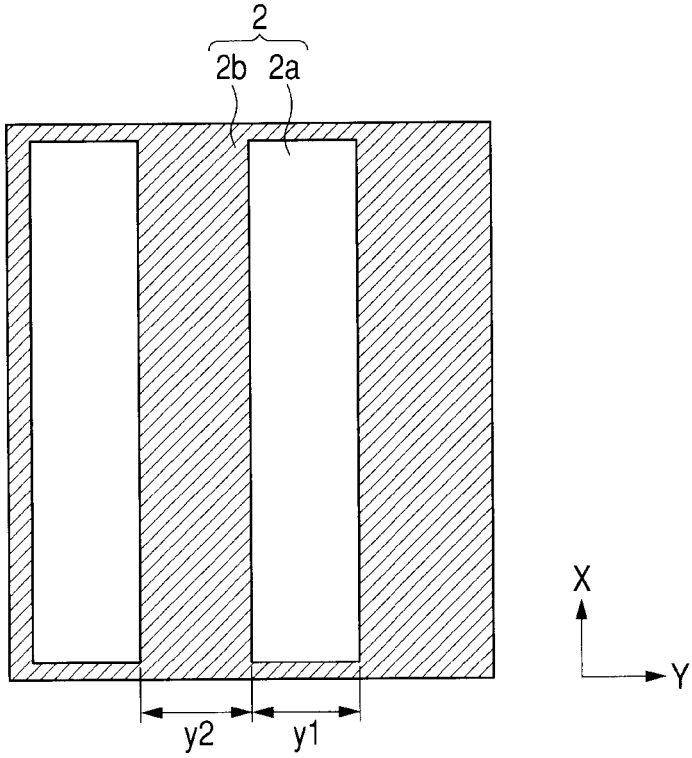

FIGS. 1A and 1B are plane schematic views respectively illustrating the shapes of masks to be used for manufacturing the conductive member 4*c* illustrated in FIG. 3C. In FIG. 1A, a phase grating mask 1, which acts as a first mask, has plural aperture portions 1*a* each having a width x1 in the X direction. Further, a portion 1*b* between the aperture portions adjacent in the X direction (that is, this portion acts as a light shielding portion) has a width x2 in the X direction. Here, it should be noted that the first lines are finally determined by the relevant aperture portions 1*a*. In FIG. 1B, a mask 2, which acts as a second mask, has aperture portions 2*a* extending in the X direction and each having a width y1 in the Y direction. Further, a portion 2*b* between the aperture portions adjacent in the Y direction (that is, this portion acts as a light shielding portion) has a width y2 in the Y direction. The width y1 of the aperture portion 2*a* of the second mask 2 corresponds to a maximum length y5 of the conductive member 4*c* illustrated in FIG. 3C, and the pitches of the aperture portions 2*a* in the Y direction correspond to the pitches of the conductive members 4*c* in the Y direction as illustrated in FIG. 3C.

Hereinafter, respective steps in the manufacturing method of the conductive members according to the present invention will be described with reference to FIGS. 2A, 2B, 2C, 3A, 3B and 3C.

(Film Forming Step)

Figure 2A:
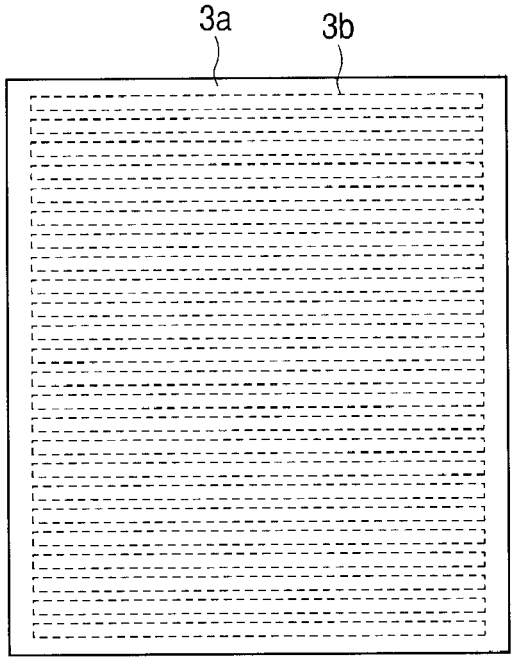
FIGS. 2A, 2B and 2C are process charts for describing a manufacturing method of a conductive member, according to the embodiment of the present invention.
Figure 2B:
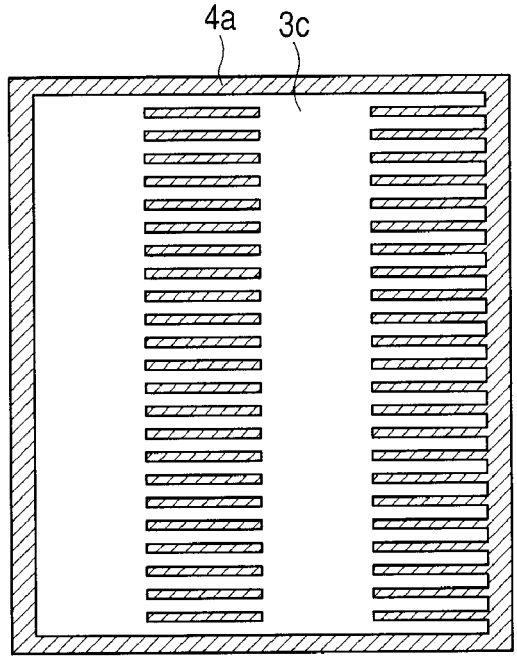
Figure 2C:
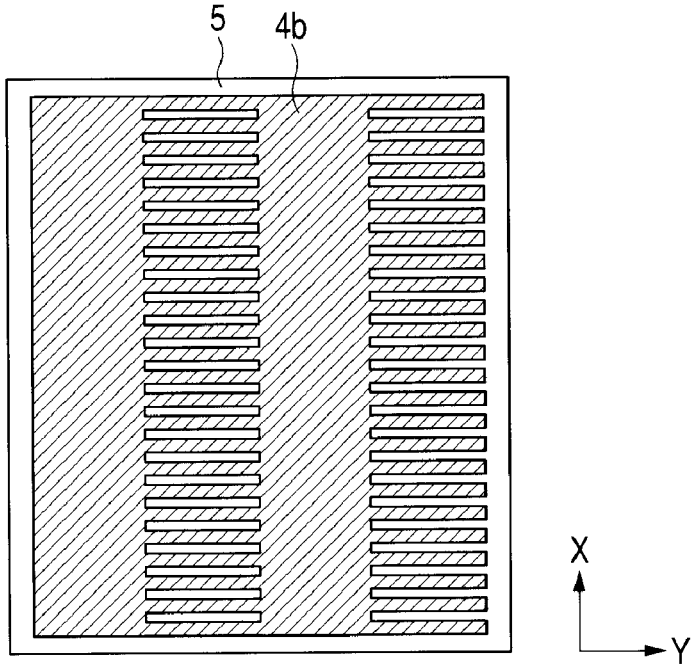

A conductive film (4*a* in FIG. 2B) is formed on a substrate (5 in FIG. 2C).

(Photosensitive Resin Applying Step)

A negative photosensitive resin (3*a* in FIG. 2A) is applied onto the conductive film.

(First Exposing Step)

The negative photosensitive resin is subjected to two-beam interference exposure by using the first mask 1. As illustrated in FIG. 2A, on the exposed negative photosensitive resin 3*a*, exposed areas 3*b* corresponding to the aperture portions 1*a* have been hardened.

(Second Exposing Step)

After the first exposing step was performed, the negative photosensitive resin 3*a* is not developed. Instead, the negative photosensitive resin 3*a* is successively exposed by using the second mask 2. That is, the area corresponding to the aperture portion 2*a* of the second mask 2 is exposed and hardened by performing the second exposing step.

(Resist Forming Step)

If the negative photosensitive resin 3*a* is developed after the second exposing step was performed, as illustrated in FIG. 2B, the areas corresponding to the aperture portions 1*a* of the first mask and the areas corresponding to the aperture portions 2*a* of the second mask are formed as a first resist (resist pattern) 3*c* on the conductive film 4*a*.

(First Conductive Film Pattern Forming Step)

If the conductive film 4*a* is etched by using the resist pattern 3*c* as a mask, a first conductive film pattern 4*b* of which the shape corresponds to the resist 3*c* is obtained (FIG. 2C).

(Photosensitive Resin Applying Step)

Figure 3A:
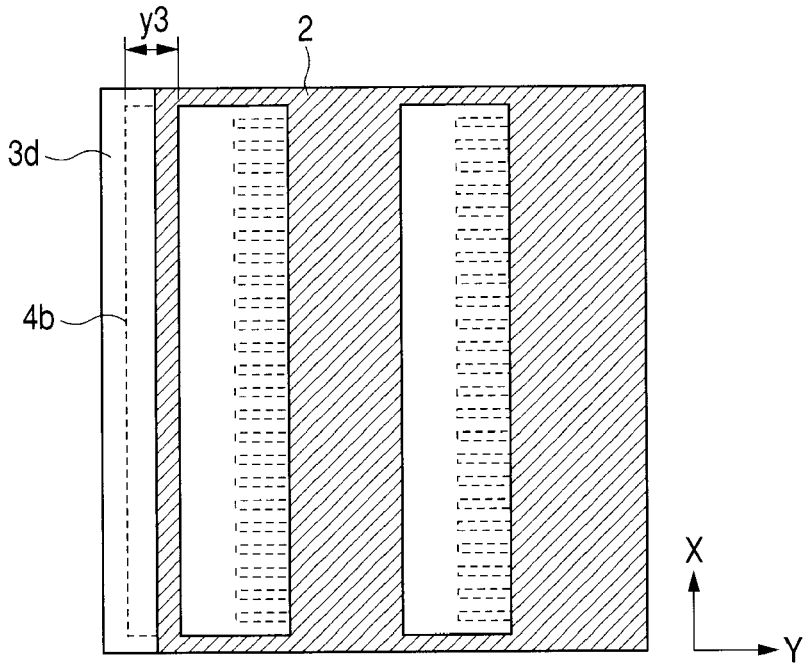
FIGS. 3A, 3B and 3C are process charts for describing the manufacturing method of the conductive member, according to the embodiment of the present invention.

A negative photosensitive resin is applied onto the substrate 5 (3*d* in FIG. 3A).

(Second Resist Forming Step)

The second mask 2 is arranged on the substrate 5 to which the negative photosensitive resin 3*d* has been applied, and the arranged second mask 2 is exposed. At that time, the second mask 2 is shifted toward the Y direction from the position at which the second mask was arranged in the second exposing step (FIG. 3A). Here, it should be noted that a shift distance y3 at this time finally corresponds to a distance y6 between the conductive members 4*c* which are adjacent in the Y direction in FIG. 3C. Incidentally, FIG. 3A illustrates, as a matter of convenience, that the edge portion of the negative photosensitive resin 3*d* at the left side of the drawing is away from the edge portion of the second mask 2 and thus exposed. However, it should be noted that the negative photosensitive resin 3*d* is typically light-shielded by means of the periphery of the second mask which has been formed so as to be wider than the negative photosensitive resin.

Figure 3B:
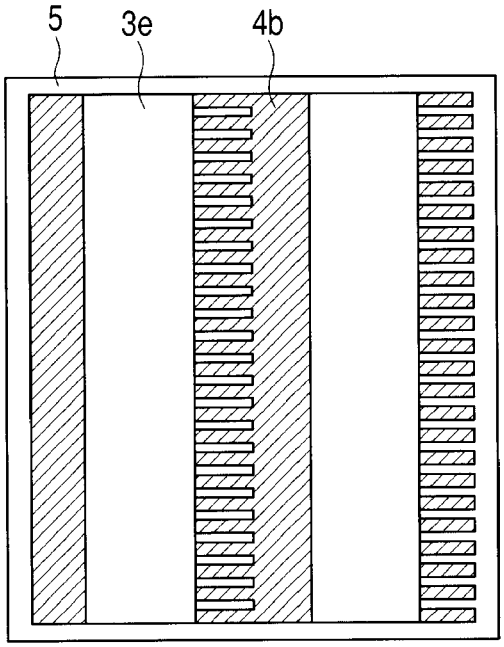
Figure 3C:
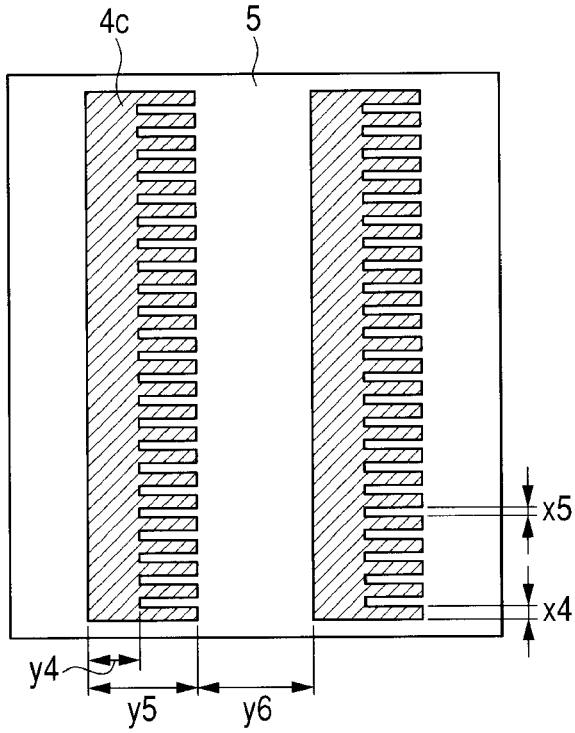

After the exposure was performed, the negative photosensitive resin 3*d* is developed. Thus, as illustrated in FIG. 3B, a second resist 3*e* which covers a part of the first conductive film pattern 4*b* is formed.

(Second Conductive Film Pattern Forming Step)

If the first conductive film pattern 4*b* is etched by using the second resist 3*e* as a mask, the comblike conductive member 4*c* as illustrated in FIG. 3C is obtained as the second conductive film pattern.

By the way, in the present embodiment, the constitution that the two conductive members 4*c* are arranged in the Y direction is provided for convenience of explanation. However, according to the present invention, a constitution that the plural conductive members are arranged in the X direction can preferably be manufactured. In such a case, the aperture portions 2*a* of the second mask 2 are formed to be divided into the plural portions taken along the Y direction so as to correspond to the second lines of the conductive members.

As described above, in the present invention, the first mask 1 which has the striped patterns corresponding to only the micropatterns is used in the first exposing step. For this reason, it only has to perform mask alignment with a high degree of accuracy only in the X direction in this step, whereby it is easy. In addition, the second mask 2 for which the mask alignment is easier as compared with the first mask is shifted in the second resist forming step, whereby it is possible to perform the mask alignment easily. As a result, it is possible to wholly perform the patterning of the conductive members 4*c* with a high degree of accuracy.

Incidentally, the micropattern to which the present invention is applicable has to satisfy a condition that the width x4 of each of the first lines is 1 μm to 2 μm and a width x5 between the adjacent first lines is 1 μm to 2 μm.

Subsequently, a case where the manufacturing method of the conductive member according to the present invention is applied to a manufacturing method of an electron source will be described. Here, it should be noted that the electron source to which the present invention is applied has a constitution that plural electron-emitting devices, each of which has conductive members each having an electron-emitting portion between a pair of electrodes, are arranged on a substrate and an opposed substrate which has light-emitting members such as phosphors or the like is arranged so as to be opposed to the above-described substrate at a predetermined distance, thereby constituting an image displaying apparatus. In any case, the manufacturing method according to the present invention is applied to the manufacture of the conductive member. In particular, the manufacturing method according to the present invention is preferably used in a case where one electron-emitting device has plural conductive members.

Figure 4A:
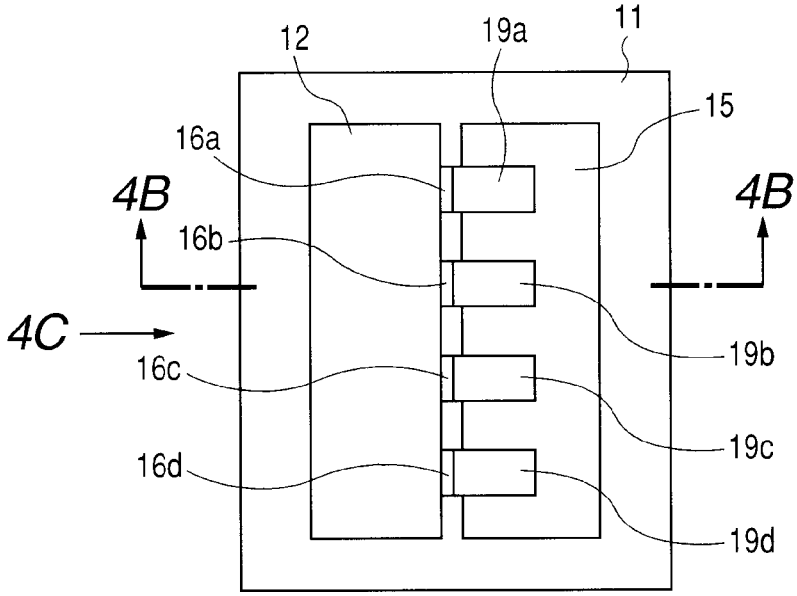
FIGS. 4A, 4B and 4C are diagrams illustrating an example of the constitution of an electron-emitting device of an electron source, manufactured in the present invention.
Figure 4B:
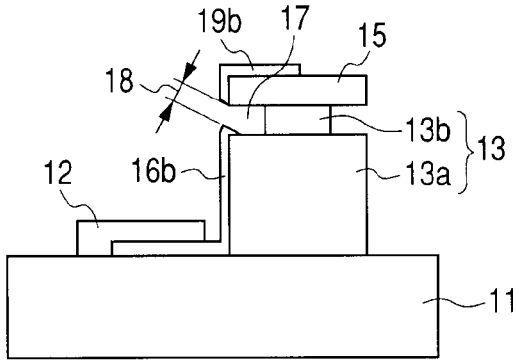
Figure 4C:
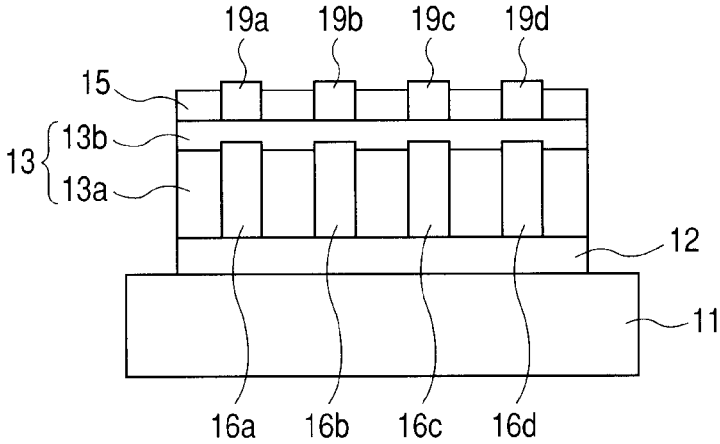

FIGS. 4A, 4B and 4C are diagrams illustrating an example of the constitution of the electron-emitting device of the electron source to which the manufacturing method according to the present invention is suitably used. More specifically, FIG. 4A is the plan of the electron-emitting device, FIG. 4B is the cross section diagram which is taken along the line 4B-4B in FIG. 4A, and FIG. 4C is the side elevation which is viewed from the direction indicated by the arrow 4C in FIG. 4A. FIGS. 4A to 4C illustrate a substrate 11, an electrode 12 which defines the potential of later-described plural cathodes 16*a*, 16*b*, 16*c* and 16*d*, an insulating member 13 which includes insulating layers 13*a* and 13*b*, a gate 15, a concave portion 17 which is provided on the insulating member 13 so as to increase the field intensity between the cathodes 16*a* to 16*d* and the gate 15, a gap 18 which is positioned between each of the cathodes 16*a* to 16*d* and the gate 15, and protruding portions 19*a*, 19*b*, 19*c* and 19*d* which are respectively formed on the gate 15. In the constitution like this, if a voltage is applied between the electrode 12 and the gate 15, electrons are emitted from each of the cathodes 16*a* to 16*d*. That is, it should be noted that the gap 18 between the cathode 16*a* and the protruding portion 19*a*, the gap 18 between the cathode 16*b* and the protruding portion 19*b*, the gap 18 between the cathode 16*c* and the protruding portion 19*c*, and the gap 18 between the cathode 16*d* and the protruding portion 19*d* resultingly constitute an electron-emitting portion.

According to the constitution as described above, since the electrons are emitted from the plural strip-shaped conductive members (that is, the four cathodes 16*a* to 16*d* and the four protruding portions 19*a* to 19*d* in the present embodiment) which are included in the one electron-emitting device, it is possible to increase an amount of the electrons to be emitted. In addition, according as the number of the conductive members included in the one electron-emitting device becomes large, it becomes possible to operate the electron-emitting device stably. For this reason, it is necessary to make the width of each of the conductive members fine.

In any case, it should be noted that the cathodes 16*a* to 16*d* and the protruding portions 19*a* to 19*d* of the electron-emitting device as described above are equivalent to the first lines of the conductive member manufactured according to the present invention. For this reason, although it is not illustrated, the cathodes 16 to 16*d* are mutually connected by means of the second line below the electrode 12.

Subsequently, the manufacturing method of the electron source according to the present invention will be described by using, as an example, the constitution of FIGS. 4A to 4C on which the plural electron-emitting devices are arranged.

Figure 5A:
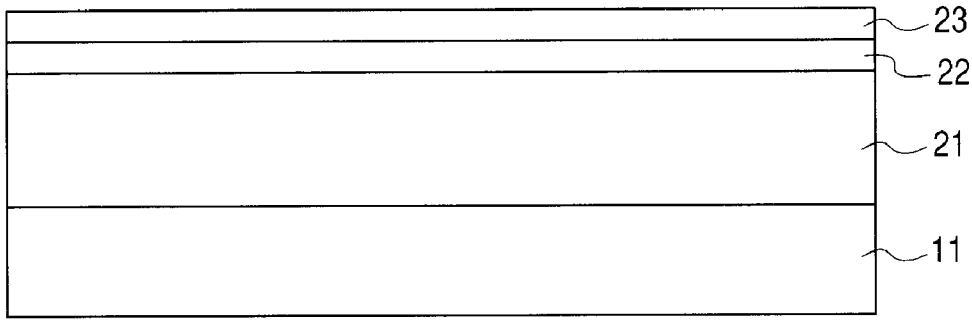
FIGS. 5A, 5B and 5C are process charts for describing a manufacturing method of the electron source, according to an example of the present invention.

First of all, insulating layers 21 and 22 and a conductive layer 23 are laminated in this order on the substrate 11 (FIG. 5A).

The substrate 11 is an insulative substrate which is used to mechanically support the device. Further, a silica glass, a glass of which the content of an impurity such as Na or the like is reduced, a soda-lime glass and a silicon substrate are preferably used as the materials of the substrate 11. Here, it is necessary for the substrate 11 to have high mechanical intensity. In addition, it is also necessary for the substrate 11 to be able to withstand dry etching, wet etching, and alkali and acid of a developing solution or the like. Furthermore, if the substrate is used as a united part as in the case of manufacturing a display panel, it is desirable to make a thermal expansion difference between the substrate and a film forming material or other laminating materials smaller. Besides, it is desirable for the substrate to use a material in which an alkali element or the like does not easily diffuse from the inside of the glass when a heat treatment is performed.

Each of the insulating layers 21 and 22 is an insulative film which consists of a material being excellent in processability. For example, the relevant insulating layer consists of SiN ($Si_xN_y$) or $SiO_2$, and is formed by a general vacuum film forming method such as a sputtering method or the like, a CVD (chemical vapor deposition) method, or a vacuum vapor deposition method. The thickness of each of the insulating layers 21 and 22 is set to have a value within the range of 5 nm to 50 μm, and this value is preferably selected within the range of 50 nm to 500 nm. Incidentally, since it is necessary to form the concave portion 17 after laminating the insulating layers 21 and 22, it is necessary to set an etching amount of the insulating layer 21 and an etching amount of the insulating layer 22 different from each other. That is, it is desirable to set a selection ratio between the insulating layer 21 and the insulating layer 22 to be 10 or higher, and preferably to be 50 or higher if possible. More specifically, the insulative material such as $Si_xN_y$ is used for of the insulating layer 21, and the insulative material such as $SiO_2$ or the like is used as the insulating layer 22. Alternatively, it is possible to use a PSG (phosphosilicate glass) film of which the phosphorus density is high, a BSG (borosilicate glass) film of which the boric acid density is high.

On the other hand, the conductive layer 23 is formed by the general vacuum film forming method such as a vapor deposition method, a sputtering method or the like. Further, it is desirable as the material constituting the conductive layer 23 to use a material which has high thermal conductivity in addition to electrical conductivity and of which the melting point is high. For example, a metal or an alloy material such as Be, Mg, Ti, Zr, Hf, V, Nb, Ta, Mo, W, Al, Cu, Ni, Cr, Au, Pt, Pd or the like, and carbide such as TiC, ZrC, HfC, TaC, SiC, WC or the like are used. Further, boride such as $HfB_2$, $ZrB_2$, $CeB_6$, $YB_4$, $GdB_4$ or the like, nitride such as TiN, ZrN, HfN, TaN or the like, a semiconductor such as Si, Ge or the like, and an organic polymer material are used for the conductive layer. In addition, amorphous carbon, graphite, diamondlike carbon, carbon and a carbon compound in which diamond is dispersed are also used. That is, the material which constitutes the conductive layer 23 is appropriately selected from among the above-described materials.

In addition, the thickness of the conductive layer 23 is set to have a value within the range of 5 nm to 500 nm, and this value is preferably selected within the range of 50 nm to 500 nm.

Figure 5B:
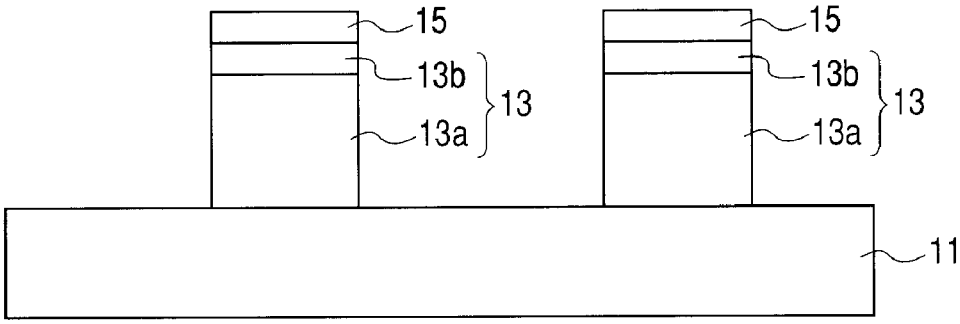

Subsequently, the resist pattern is formed on the conductive layer 23 in the photolithography technique. After then, the conductive layer 23, the insulating layer 22 and the insulating layer 21 are sequentially processed by using the etching method. As a result, it is possible to obtain the insulating members 13 each of which includes the gate 15, the insulating layer 13*b* and the insulating layer 13*a* (FIG. 5B).

In the etching process like this, RIE (Reactive Ion Etching) is used. Generally, in the RIE, plasma of an etching gas is generated as a processing gas, and the generated processing gas is irradiated to the material, thereby enabling to perform the accurate etching process to the material. As the processing gas to be used in this case, a fluorinated gas such as $CF_4$, $CHF_3$ or $SF_6$ is selected if the material to be processed finally comes to be fluoride. Further, if chloride such as Si or Al is formed, a chlorinated gas such as $Cl_2$, $BCl_3$ or the like is selected. Besides, to set a selection ratio between the material and the resist, a hydrogen gas, an oxygen gas, an argon gas or the like is added as needed so as to ensure flatness and smoothness of the etched surface or increase etching speed.

Figure 5C:
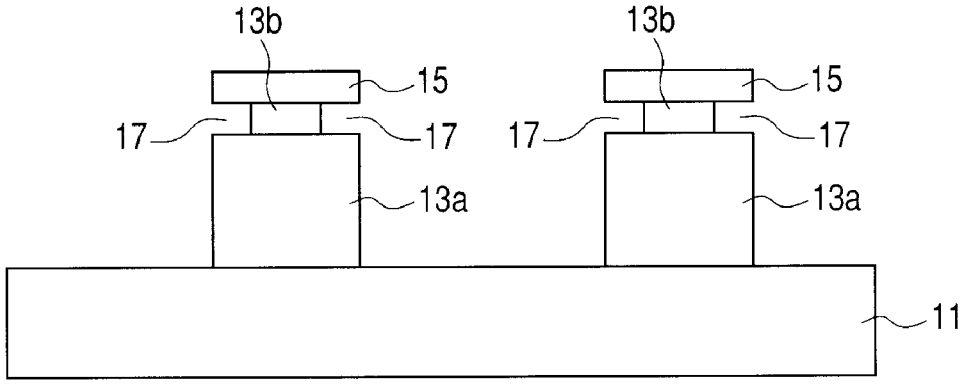

Subsequently, only the side surface of the insulating layer 13*b* is partially eliminated on one side surface of the laminated body by using the etching method, thereby forming the concave portions 17 for the insulating members 13 (FIG. 5C).

For example, if the material of the insulating layer 13*b* consists of $SiO_2$, it is possible in the etching method to use a mixed solution which includes ammonium fluoride and hydrofluoric acid and is popularly called BHF (Buffered Hydrogen Fluoride). On the other hand, if the material of the insulating layer 13*b* consists of $Si_xN_y$, it is possible to perform the etching by using a thermal phosphoric etching solution.

Here, it should be noted that the depth of the concave portion 17, which is equivalent to the distance between the side surface of the insulating layer 13*b* and the side surfaces of the insulating layer 13*a* and the gate 15 in the concave portion 17, is deeply related to a leakage current which flows after the device was formed. More specifically, if the depth of the concave portion 17 is made deeper, the value of the leakage current becomes small. However, if the depth of the concave portion 17 is made too deep, a problem of, for example, deformation of the gate 15 occurs. Therefore, in order to prevent this problem, the depth of the concave portion 17 is formed to have a value within the range of 30 nm to 200 nm or so.

After then, the cathodes 16*a* to 16*d* and the protruding portions 19*a* to 19*d* are formed by using the manufacturing method of the conductive member according to the present invention.

First, the conductive film is formed on the overall substrate. Here, as the material constituting the conductive film, a material which has electrical conductivity and performs field emission may be used. In general, it is preferable to use a material which has a high melting point of 2000° C. or higher, which has a work function of 5 eV or lower, and for which it is difficult to form a chemical reaction layer such as oxide or the like or it is easy to eliminate a reaction layer. For example, a metal or an alloy material such as Hf, V, Nb, Ta, Mo, W, Au, Pt, Pd or the like, carbide such as TiC, ZrC, HfC, TaC, SiC, WC or the like, and boride such as $HfB_2$, $ZrB_2$, $CeB_6$, $YB_4$, $GdB_4$ or the like are used as the above-described material. Further, nitride such as TiN, ZrN, HfN, TaN or the like, amorphous carbon, graphite, diamondlike carbon, carbon and a carbon compound in which diamond is dispersed, and the like are used.

Further, as a method of depositing the conductive film, it is preferable to use a general vacuum film forming technique such as a vapor deposition method, a sputtering method or the like. Further, EB (electron beam) deposition is preferably used.

Figure 6A:
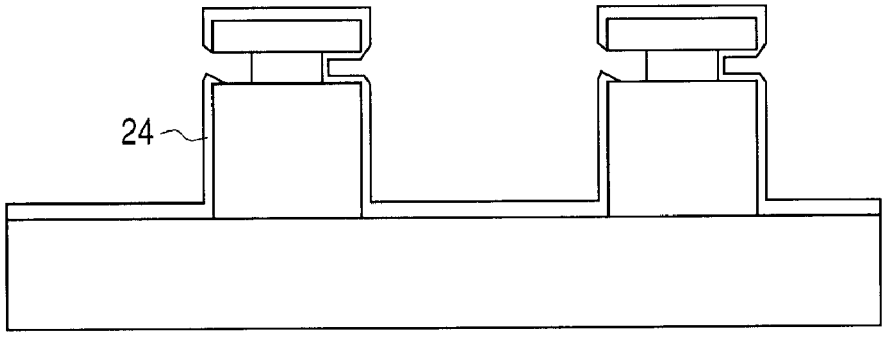
FIGS. 6A, 6B and 6C are process charts for describing the manufacturing method of the electron source, according to the example of the present invention.

The negative photosensitive resin is applied onto the conductive film, the resist is formed in the first exposure in which the first mask is used and in the second exposure in which the second mask is used, and the conductive film is etched by using the formed resist as the mask, thereby obtaining a first conductive film pattern 24 (FIG. 6A). At this stage, as illustrated in FIG. 6A, the cathodes are arranged on both the sides of the single gate 15. In such a constitution, since the electrons are emitted from both the cathodes on the right and left sides of the gate, the electrons emitted from the cathode on any one of these sides reach the position which is different from the light-emitting member which should emit light. For this reason, it is necessary to eliminate the cathode on any one of these sides. Incidentally, it should be noted that the second line is positioned between the adjacent laminated bodies.

Figure 6B:
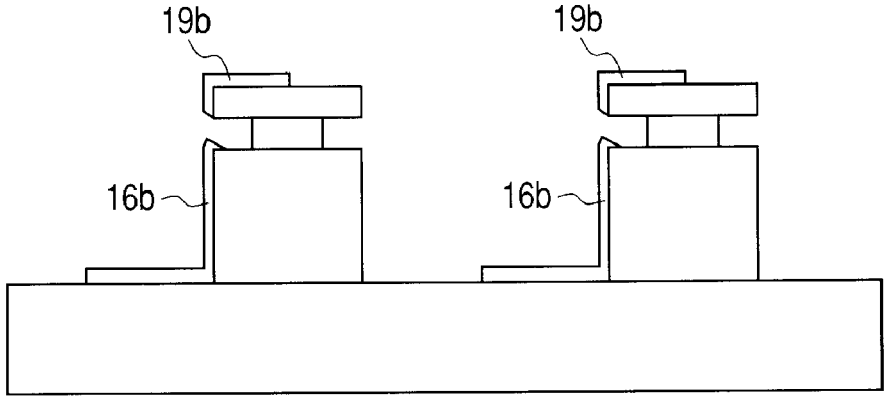

On the substrate 11 on which the first conductive film pattern 24 has been formed as described above, a new negative photosensitive resin is applied. Then, the second mask is shifted in the X direction, that is, in the horizontal direction on the drawing, the applied negative photosensitive resin is exposed to form a resist, and then etching is performed by using the formed resist. As a result of this process, the protruding portion 19*b* and the cathode 16*b* remain only on one side of the concave portion 17 (FIG. 6B).

Here, as the etching method of the conductive film, both dry etching and wet etching are preferably used.

Figure 6C:
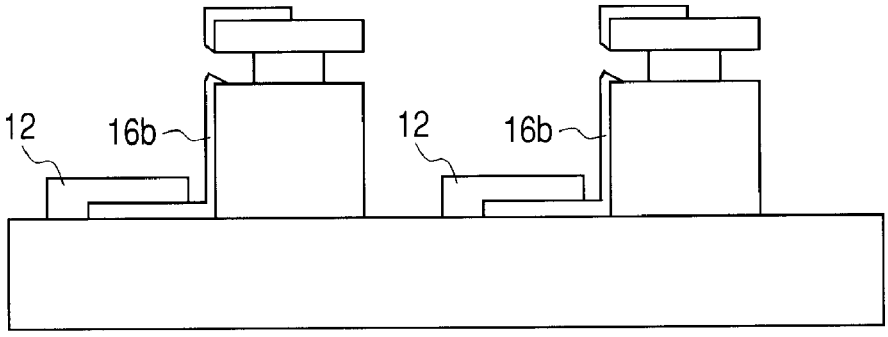

Subsequently, the electrode 12 is formed so as to establish electrical connection to the cathode 16*b* (FIG. 6C). Here, it should be noted that the formed electrode 12 has electrical conductivity as well as the cathode 16*b*, and is formed by the general vacuum film forming technique such as the vapor deposition method, the sputtering method or the like, or the photolithography technique. As the material of the electrode 12, for example, a metal or an alloy material such as Be, Mg, Ti, Zr, Hf, V, Nb, Ta, Mo, W, Al, Cu, Ni, Cr, Au, Pt, Pd or the like, and carbide such as TiC, ZrC, HfC, TaC, SiC, WC or the like are used. Further, boride such as $HfB_2$, $ZrB_2$, $CeB_6$, $YB_4$, $GdB_4$ or the like, nitride such as TiN, ZrN, HfN or the like, a semiconductor such as Si, Ge or the like, and an organic polymer material are used. In addition, amorphous carbon, graphite, diamondlike carbon, carbon and a carbon compound in which diamond is dispersed, and the like are also used. That is, the material which constitutes the electrode 12 is appropriately selected from among the above-described materials.

In addition, the thickness of the electrode 12 is set to have a value within the range of 50 nm to 5 mm, and this value is preferably selected within the range of 50 nm to 5 μm.

The electrode 12 and the gate 15 may be formed by an identical material or may be formed by respectively different materials. Also, the electrode 12 and the gate 15 may be formed by an identical forming method or may be formed by respectively different kinds of forming methods. Here, since the gate 15 might be set within a range that the thickness of the gate 15 is thinner as compared with the thickness of the electrode 12, it is desirable for the gate 15 to use a low-resistance material.

Hereinafter, an image displaying apparatus which is equipped with the electron source according to the present invention will be described with reference to FIG. 7.

Figure 7:
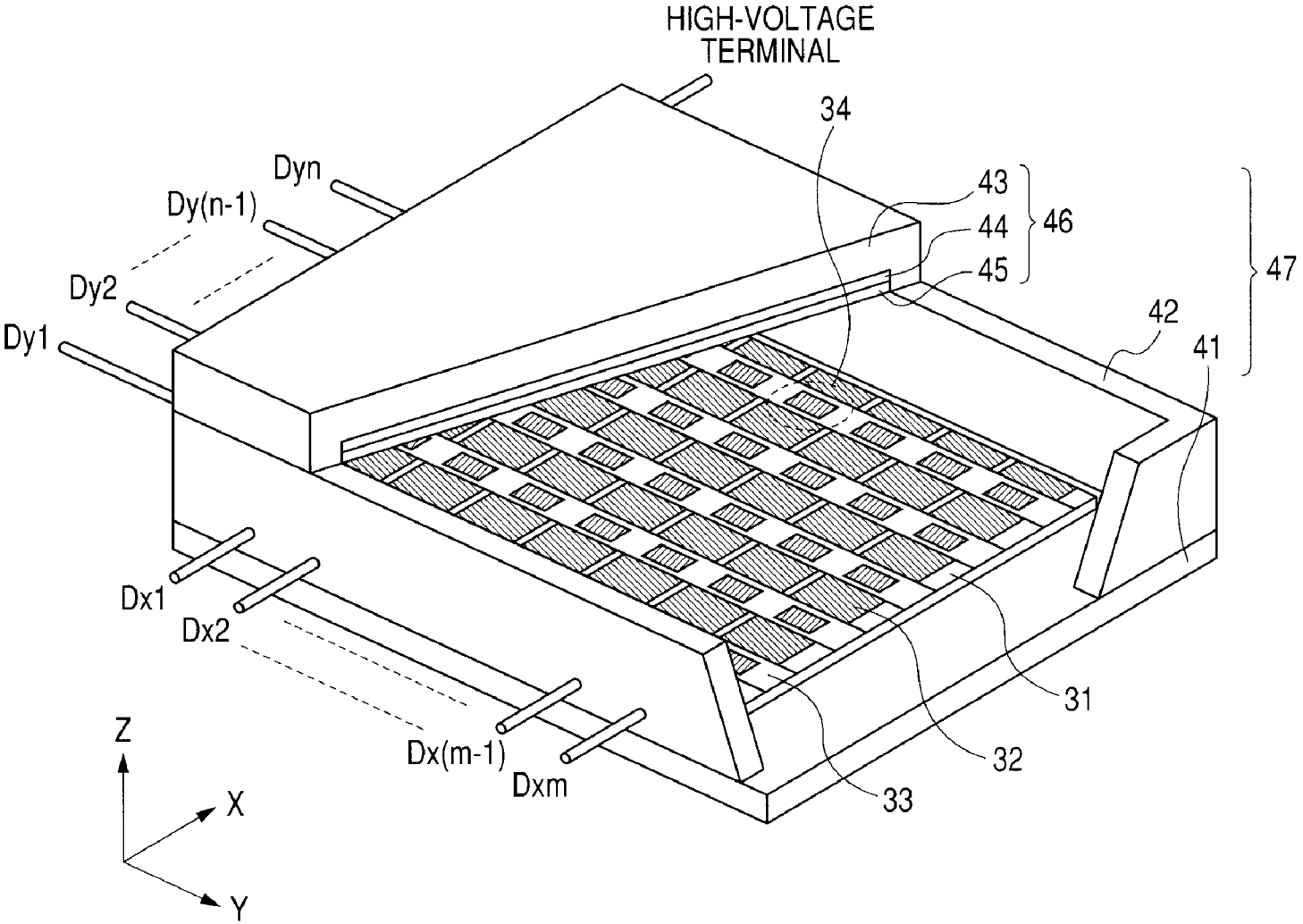
FIG. 7 is a perspective diagram illustrating an example of the constitution of a display panel of an image displaying apparatus which uses the electron source manufactured according to the present invention.

That is, FIG. 7 roughly illustrates an electron source substrate 31, X-direction wirings 32, Y-direction wirings 33, and electron-emitting devices 34. More specifically, the X-direction wirings 32 are the wirings which are used to commonly connect the electrodes 12, and the Y-direction wirings 33 are the wirings which are used to commonly connect the gates 15.

Here, the X-direction wirings 32, which include m wirings of Dx1, Dx2, . . . , and Dxm, can be manufactured by a conductive metal or the like formed by a vacuum vapor deposition method, a printing method, a sputtering method, or the like. Incidentally, it should be noted that the material, the thickness and the width of the wiring are properly designed.

Further, the Y-direction wirings 33, which include n wirings of Dy1, Dy2, . . . , and Dyn, can be manufactured in the same manner as that for the X-direction wirings 32. In any case, a not-illustrated interlayer insulating layer is provided between the m X-direction wirings 32 and the n Y-direction wirings 33 so as to electrically separate these wirings (here, both m and n are positive integers).

The not-illustrated interlayer insulating layer consists of $SiO_2$ or the like which is formed by the vacuum vapor deposition method, the printing method, the sputtering method, or the like. For example, the desired-shaped interlayer insulating layer is formed on the overall surface or a part of the surface of the electron source substrate 31 on which the X-direction wirings 32 have been formed. In particular, the thickness, the material and the width of the interlayer insulating layer are properly set so that the interlayer insulating layer can withstand a potential difference at the intersection point of the X-direction wiring 32 and the Y-direction wiring 33. In any case, it should be noted that the X-direction wirings 32 and the Y-direction wirings 33 have been pulled out respectively as external terminals.

Further, it should be noted that cathodes and gates (both not illustrated) constituting the electron-emitting devices 34 in the present invention are electrically connected to the m X-direction wirings 32 and the n Y-direction wirings 33.

A part or the whole of constituent elements of the materials of the X-direction wiring 32, the Y-direction wiring 33, the cathode and the gate may be the same, or different respectively.

A not-illustrated scanning signal supplying unit is connected to the X-direction wirings 32 so as to supply a scanning signal to select the row of the electron-emitting devices 34 arranged in the X direction. On the other hand, a not-illustrated modulation signal generating unit is connected to the Y-direction wirings 33 so as to generate a modulation signal for modulating, in response to input signals, each column of the electron-emitting devices 34 arranged in the Y direction.

Here, it should be noted that a driving voltage which is applied to each of the electron-emitting devices is supplied as a difference voltage between the scanning signal and the modulation signal which are supplied to the relevant electron-emitting device.

It should be noted that, in the above-described constitution, it is possible, by using simple matrix wirings, to select individual device and independently drive the selected device.

Incidentally, as illustrated in FIG. 7, the electron source substrate 31 is fixed to a rear plate 41. Further, a metal back 45 which is equivalent to an anode, a fluorescent film 44 which is equivalent to a phosphor acting as a light-emitting member positioned on the anode, and the like are formed on the inner surface of a glass substrate 43. Here, the glass substrate 43, the fluorescent film 44 and the metal back 45 together constitute a face plate 46.

Further, the rear plate 41 and the face plate 46 are connected to a support frame 42 by means of a frit glass or the like. An envelope 47 is formed by baking and thus bonding the rear plate 41, the support frame 42 and the face plate 46 together, for example, at a temperature within a temperature range of 400° C. to 500° C. for ten minutes or more in the atmosphere or nitrogen.

Incidentally, the electron-emitting device 34 is equivalent to the electron-emitting device illustrated in FIGS. 1A and 1B. Further, the X-direction wiring 32 and the Y-direction wiring 33 are respectively the X-direction wiring and the Y-direction wiring which are connected respectively to the electrode 12 and the gate 15 of the electron-emitting device.

As described above, the envelope 47 is formed by the face plate 46, the support frame 42 and the rear plate 41. Here, it should be noted that the rear plate 41 is provided with intend to mainly reinforce the strength of the electron source substrate 31. Therefore, if the electron source substrate 31 itself has the sufficient strength, it is possible to refrain from independently providing the rear plate 41.

That is, the support frame 42 may be directly bonded to the electron source substrate 31 so as to constitute the envelope 47 by the face plate 46, the support frame 42 and the electron source substrate 31. On the other hand, it is also possible to constitute the envelope 47 which has sufficient strength against atmospheric pressure, by providing a not-illustrated support member called a spacer between the face plate 46 and the rear plate 41.

In such an image displaying apparatus as described above, phosphors are aligned and arranged on the light-emitting devices in consideration of orbital of emitted electrons.

As described above, the emitted electrons are accelerated and irradiated to the phosphors by applying the scanning signal, the modulation signal and the high voltage to the anodes, thereby achieving the image display.

Example 1

The electron source which has the plural electron-emitting devices described in FIGS. 1A and 1B was manufactured according to the procedure of the steps illustrated in FIGS. 5A to 5C and FIGS. 6A to 6C.

First, the PD200 which is low-sodium glass developed to be used for a plasma display was used as the substrate 11, and an SiN ($Si_xN_y$) layer having the thickness of 500 nm was formed as the insulating layer 21 by the sputtering method. Then, an $SiO_2$ layer having the thickness of 30 nm was formed as the insulating layer 22 by the sputtering method. Further, a TaN layer having the thickness of 30 nm was laminated as the conductive layer 23 on the insulating layer 22 by the sputtering method (FIG. 5A).

Subsequently, the resist pattern was formed on the conductive layer 23 by the photolithography technique, and then the conductive layer 23, the insulating layer 22 and the insulating layer 21 were sequentially processed in due order by using the dry etching method, thereby forming the gates 15 and the insulating members 13 each including the insulating layers 13*a* and 13*b* (FIG. 5B). At that time, since a material for producing fluoride was selected as the materials of the insulating layers 21 and 22 and the conductive layer 23, a $CF_4$ gas was used as a processing gas. Here, the RIE was performed by using the $CF_4$ gas, with the result that each of the insulating layers 13*a* and 13*b* and the gate 15 had, after the etching, an angle of approximately 80° in regard to the horizontal surface of the substrate 11. Further, the width of the gate 15 in the X direction was 100 μm.

Then, the resist was removed, and thereafter the side surface of each of the insulating layers 13*b* was etched by using the etching method. In the relevant etching method, the concavity of which the depth is approximately 70 nm was formed by using the BHF (Buffered Hydrogen Fluoride) which is the mixed solution of ammonium fluoride and hydrofluoric acid, whereby the concave portions 17 was formed on the insulating members 13 (FIG. 5C).

Then, molybdenum (Mo) which is the material for the cathode was adhered onto the gates 15, to the side surfaces of the insulating members 13 and onto the surface of the substrate 11. In this example, the EB deposition method was used as the film forming method. In this method, the angle of the substrate was set to 60° in regard to the horizontal surface. As a result of this, the incident angle of Mo in regard to the upper surface of the gate 15 was 60°, and the incident angle of Mo in regard to the inclined surface of the insulating material 13 after the RIE process was 40°. In addition, the deposition speed was set to approximately 12 nm/min, and the thickness of the Mo film on the inclined surface was formed to 30 nm by accurately controlling the deposition time of 2.5 minutes.

After the Mo film was formed, the negative photosensitive resin (photoresist "NFR111D2H" manufactured by JSR Corporation) was applied to the overall substrate 11, and the applied negative photosensitive resin was dried.

Subsequently, the two-beam interference exposure (that is, the exposure based on only ± primary light from the mask) was performed by using the first mask of x1=x2=3 μm, and then the double exposure was performed by using the second mask of y1=3 μm, y2=3 μm. After then, the development was performed by using a developer NMD3 (TMAH (tetramethyl ammonium hydroxide) developer) to obtain the resist, and the dry etching was performed by using the $CF_4$ gas with use of the obtained resist as the mask, whereby the first conductive film pattern 24 was obtained (FIG. 6A).

Next, the negative photosensitive resin was again applied and dried. Then, the second mask was shifted toward the Y direction by 1.5 μm, the normal exposure was performed, and the development was performed by using the developer NMD3, whereby the resist was obtained. Further, the dry etching was performed to the first conductive film pattern 24 by using the $CF_4$ gas with use of the obtained resist as the mask. Thus, as illustrated in FIG. 6B, the constitution that the cathode 16*b* and the protruding portion 19*b* are arranged on only one side of each laminated body which consists of the insulating material 13 and the gate 15 was obtained.

Here, the width of each of the obtained cathode 16*b* and the obtained protruding portion 19*b* was 1.5 μm.

Subsequently, Cu of which the thickness is 500 nm was deposited by the sputtering method, and the patterning was performed, whereby the electrodes 12 were formed. Then, in regard to the electron-emitting device manufactured as described above, voltage of 11.8 kV was applied to the anode electrode positioned to be opposed to the relevant electron-emitting device and voltage of 20V was applied between the cathode and the gate. Thus, an electron-emitting current Ie=11.8 μA (efficiency 13%) was obtained, whereby the excellent electron-emitting device was formed.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-231027, filed Sep. 9, 2008, which is hereby incorporated by reference herein in its entirety.

What is claimed is:

1. A manufacturing method of a plurality of electron-emitting devices having a plurality of conductive members on a substrate, said method comprising:

a forming step of forming a plurality of conductive members, said forming step comprising:

a film forming step of forming a conductive film on a substrate;

a step of applying a negative photosensitive resin on the conductive film;

a first exposing step of exposing the negative photosensitive resin by using a first mask which has plural aperture portions, respectively extending in a first direction, at pitches that are the same as those of first lines extending parallel to the first direction;

a second exposing step of exposing the negative photosensitive resin by using a second mask which has aperture portions, each extending in a second direction in a width that is the same as a maximum length of the conductive member taken along the first direction, at pitches that are the same as those of the conductive members in the first direction, the second direction being perpendicular to the first direction;

a step of forming a first resist by developing the negative photosensitive resin double-exposed;

a step of forming a first conductive film pattern by etching the conductive film with use of the first resist as a mask;

a step of applying a negative photosensitive resin on the substrate after the etching;

a step of forming a second resist by exposing and developing the negative photosensitive resin in a state that the second mask is being shifted toward the first direction; and a step of forming a second conductive film pattern by etching the first conductive film pattern with use of the second resist as a mask.

2. The manufacturing method according to claim 1, wherein at least one of the electron-emitting devices has the plurality of conductive members.

* * * * *